United States Patent [19]

Chalberg

[11] 4,359,790

[45] Nov. 23, 1982

[54] SUCTION OUTLET ASSEMBLY FOR WHIRLPOOL BATHS AND THE LIKE

[76] Inventor: Philip E. Chalberg, 1119 Maple Ave., Orange, Calif. 92668

[21] Appl. No.: 215,887

[22] Filed: Dec. 12, 1980

[51] Int. Cl.[3] ..... E03C 1/02; A61H 33/02

[52] U.S. Cl. ..... 4/541; 4/542; 4/191

[58] Field of Search ..... 4/541, 508, 542, 543, 4/544, 191, 192, 600, 492, 487, 488, 507; 285/161, 206; 128/66; 239/428.5, 403, 432, 383, 381, 102, 101, 590.3, 590.5, 552, 567, 568, 600

[56] References Cited

U.S. PATENT DOCUMENTS

| | | | |
|---|---|---|---|
| 1,491,873 | 4/1924 | McMurtrie | 285/161 |
| 1,885,042 | 10/1932 | Baldwin, Jr. | 285/206 X |
| 1,904,409 | 4/1933 | Church | 285/161 |
| 2,124,942 | 7/1938 | Barnard | 285/161 |
| 3,614,952 | 10/1971 | Agnellino | 128/66 |
| 4,179,038 | 12/1979 | Rosan, Jr. | 285/161 |
| 4,225,984 | 10/1980 | Lindsey | 4/544 X |
| 4,233,694 | 11/1980 | Janosko et al. | 4/542 |
| 4,262,371 | 4/1981 | Barry et al. | 4/191 |
| 4,320,541 | 3/1982 | Neenan | 4/542 X |

*Primary Examiner*—Henry K. Artis

*Attorney, Agent, or Firm*—Fischer, Tachner & Strauss

[57] ABSTRACT

A suction outlet assembly providing a path through which water within a whirlpool bath may be pumped out for recirculation. The assembly comprises three principal components, namely, an elbow structure which includes an integral flange and threaded pipe for protruding through a suitable orifice in the wall of the whirlpool bathtub into the interior of the tub; a locking ring having a matching threaded annular surface for securing the elbow structure against the tub wall by tightening the locking ring from the readily accessible interior side of the tub wall; and a suction cover which is designed to engage the locking ring in a fixed spaced-apart relation to provide a finished asthetically appealing appearance to the assembly while providing safe multiple exit paths to the water flowing therethrough. These three components of the present invention are of unique but simple structure which may be manufactured from molded plastic. The assembly may be readily installed in a whirlpool bathtub with only limited access to the tub exterior immediately adjacent the orifice through which the assembly protrudes. The assembly requires only a minimum fixed volume adjacent the tub exterior surface to accommodate the elbow structure of the invention.

8 Claims, 5 Drawing Figures

SUCTION OUTLET ASSEMBLY FOR WHIRLPOOL BATHS AND THE LIKE

BACKGROUND OF THE INVENTION

1. Field of the Invention

The present invention pertains generally to fixtures for therapy baths and more specifically, to a suction outlet assembly for providing a passage through which water within a therapy tub may be pumped out for recirculation.

2. Prior Art

The general concept of utilizing a suction outlet assembly to provide a passageway for recirculating the water within a whirlpool or therapy bath is well-known in the art. However, prior art suction outlet assemblies have one or more disadvantages relative to the present invention. More specifically, prior art suction outlet assemblies are relatively disadvantageous primarily from the standpoint of space and access requirements during installation and maintenance. By way of example, it will be seen hereinafter that the present invention is designed to provide a suction outlet assembly that requires only limited access to the whiripool bathtub exterior immediately adjacent the assembly during installation, replacement, or repair. Furthermore, it will be seen that the present invention provides an assembly structure which, because of its unique configuration, minimizes the space required at the tub exterior immediately adjacent the assembly to accommodate its installation. In the present invention the distance between the exterior surface of the tub wall and the farthest point of an elbow structure designed to redirect the water exit path towards the recirculation pump, is always minimum.

Another relevant disadvantage of prior art suction outlet assemblies relates to appearance. More specifically, it is generally well-known that one must provide a suction outlet assembly that is safe. A safe outlet is one which will not inadvertently trap a user against the outlet as a result of the pressure differential created by the recirculation pump. It has become common to employ in such outlet assemblies a protruding relatively large ribbed structure providing a large plurality of alternative water exit paths that cannot all be covered simultaneously by the user. Such multiple paths preclude injury resulting from either trapping the user against the suction outlet assembly or pinching and injuring parts of his body. However, in order to provide a structure that is sufficiently large to preclude simultaneous blockage of all possible paths, prior art structures tend to be esthetically unappealing and cumbersome which detract from the overall appearance of the whirlpool bath. The present invention provides a unique structural configuration which permits a substantially reduced outlet assembly size while preserving the aforementioned safety features wherein the water flow is separated into numerous distinct paths as will be more fully understood hereinafter.

SUMMARY OF THE INVENTION

The suction outlet assembly of the present invention comprises three principle components, namely, a novel elbow structure which includes an integral flange and threaded pipe for protruding through a suitable orifice in a tub wall into the interior of the tub; a locking ring having a matching threaded annular surface for securing the elbow structure against the tub wall by tightening the locking ring from the readily accessible interior side of the tub wall; and a suction cover which is keyed to engage the locking ring in a fixed spaced-apart configuration to provide a finished appearance to the suction outlet assembly while also providing multiple exit paths to the water flowing therethrough. In a preferred embodiment the suction cover is secured to the locking ring by means of commonly available fastening devices such as screws and the like.

The resulting configuration of elbow structure, locking ring and suction cover provides a suction outlet assembly which is easily installed with only limited access to the tub exterior immediately adjacent the orifice through which the assembly protrudes and which utilizes a minimum fixed volume adjacent the tub exterior surface to accommodate the elbow structure of the invention.

OBJECTS

It is therefore a principle object of the present invention to provide a suction outlet assembly for a whirlpool bath which is generally easier and less costly to install than comparable prior art devices.

It is an additional object of the present invention to provide a suction outlet assembly for a whirlpool bath and the like which is adapted to provide a passageway in the tub wall for pumping the water out of the bath for recirculation and which is at least as safe to the whirlpool bath user as prior art devices.

It is still an additional object of the present invention to provide a suction outlet assembly for whirlpool baths and the like which utilizes a minimum number of structurally simple and inexpensive parts that may be manufactured from molded plastic and which still provides an attractive finished appearance for maximum esthetic appeal.

BRIEF DESCRIPTION OF THE DRAWINGS

The aforementioned objects and advantages of the present invention as well as additional objects and advantages thereof will be more fully understood hereinafter as a result of the detailed description of the invention taken in conjunction with the appended drawings in which.

DETAILED DESCRIPTION OF A PREFERRED EMBODIMENT

Figure 1:
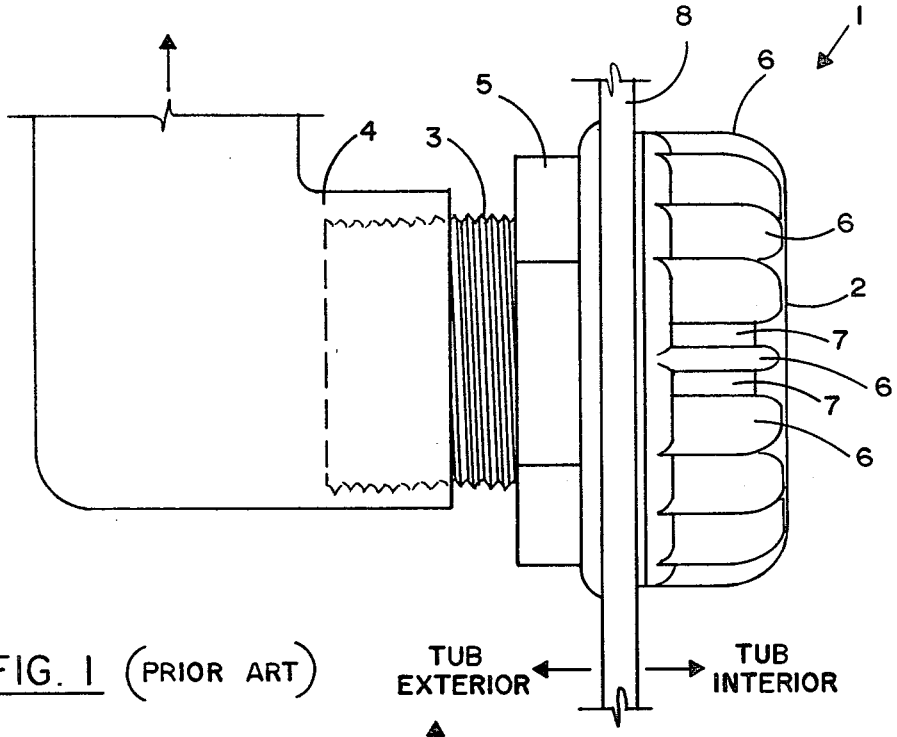
FIG. 1 (PRIOR ART)
FIG. 1 is a side view of a prior art suction outlet assembly.

Referring now to FIG. 1 there is shown a prior art suction outlet assembly 1 for a whirlpool bath. Typical of such assemblies, assembly 1 is designed to provide a safe suction outlet passage for whirlpool baths from the tub interior to the tub exterior through an orifice in tub wall 8 and through a threaded pipe 3 which is connected to an elbow 4 for directing the outlet water into a suitable pump for recirculation as is well known in the art.

As depicted in FIG. 1, the prior art assembly indicated therein consists of three principal components, including suction cover 2 which consists of a circulary arranged plurality of ribs 6 each separated from the adjacent ribs to form a plurality of interlaced apertures 7 through which exiting water may be sucked out of the whirlpool bathtub and through threaded pipe 3. Threaded pipe 3 also constitutes a part of suction cover 2. A second component of the prior art assembly of FIG. 1 is a retaining nut 5 which is a hexagonal nut having a threaded interior compatible with threaded pipe 3. During installation, after the threaded pipe 3 of cover 2 is passed through the orifice in tub wall 8, retaining nut 5 is threaded onto threaded pipe 3 until it is secured against the exterior surface of the tub wall 2 thereby forcibly engaging the suction cover 2 against the tub wall. The third component in the prior art configuration of FIG. 1 is an elbow 4. Typically, elbow 4 has a threaded interior section facing the threaded pipe 3 which has a compatible thread for being threaded onto threaded pipe 3 as illustrated in FIG. 1.

As indicated previously, the problems associated with prior art suction outlet assemblies such as the one illustrated by way of example in FIG. 1, relate to the space required between the exterior surface of tub wall 8 and the far end of elbow 4 as well as the additional space required to maneuver the elbow onto the threaded pipe 3 of the assembly during its installation. This aspect of prior art assemblies constitutes one of the principal disadvantages because the space that is available is variable depending upon the configuration of the elbow and threaded pipe and is not always sufficient. Another problem is the requirement for access to the exterior surface of tub wall 8 for tightening the retaining nut 5 as well as for securing the elbow 4 to the threaded pipe 3. Such access is not always available particularly when working with an existing whirlpool bath in which the installation of a suction outlet assembly is being carried out as a retrofit operation. In those particular instances, either the access is unavailable precluding the use of such prior art assemblies or access is obtained by brute force methods which are costly and time consuming such as breaking away existing walls or decks and replacing them after the installation is completed.

The present invention overcomes the principal disadvantages of the prior art by substantially reducing the space and access requirements for installation of a suction outlet assembly for whirlpool baths. The suction outlet assembly 10 of the present invention comprises an elbow 12 having an integral flange 14 and threaded pipe 16. Threaded pipe 16 is adapted to extend through an orifice in tub wall 18 and protrude into the tub interior. Threaded pipe 16 of elbow 12 is secured in place by a locking ring 20 which will be described more fully hereinafter. A suction cover 22 is adapted to be secured to the locking ring 20 by a pair of screws or the like to provide a safety cover which permits the water inside the whirlpool bathtub to be suctioned out through elbow 12 to a recirculating pump, (not shown). Suction cover 22 provides means for allowing the water to exit the bathtub at a high pressure differential without creating a danger that the user of the whirlpool bath will be inadvertently injured by blocking the flow of water with a part of his body.

Figure 2:
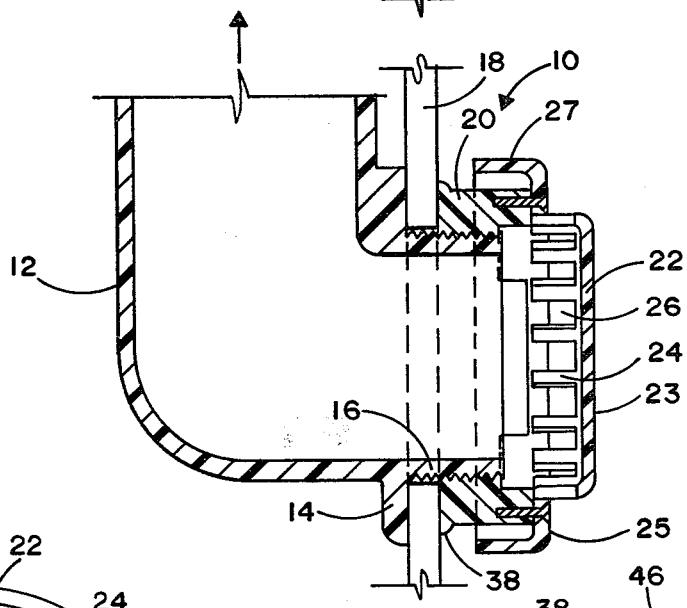
FIG. 2 is a sectional side view of a suction outlet assembly of the present invention.
Figure 3:
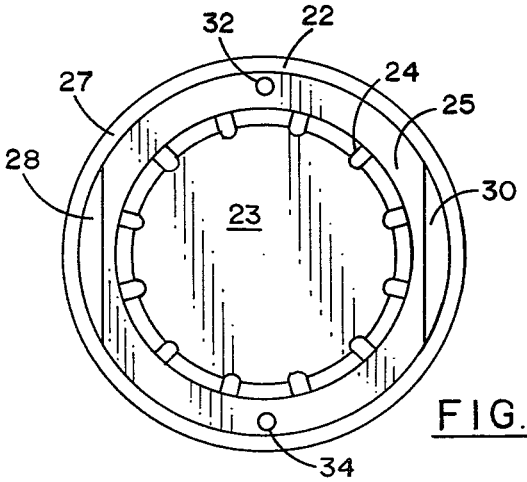
FIG. 3 is a plan view of the suction cover of the present invention as viewed from the interior thereof.
Figure 4:
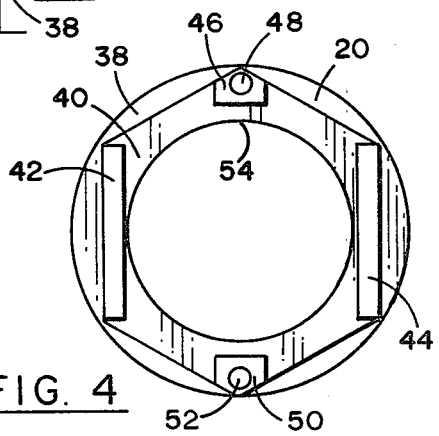
FIG. 4 is a plan view of the locking ring of the present invention as viewed from the exterior thereof.
Figure 5:
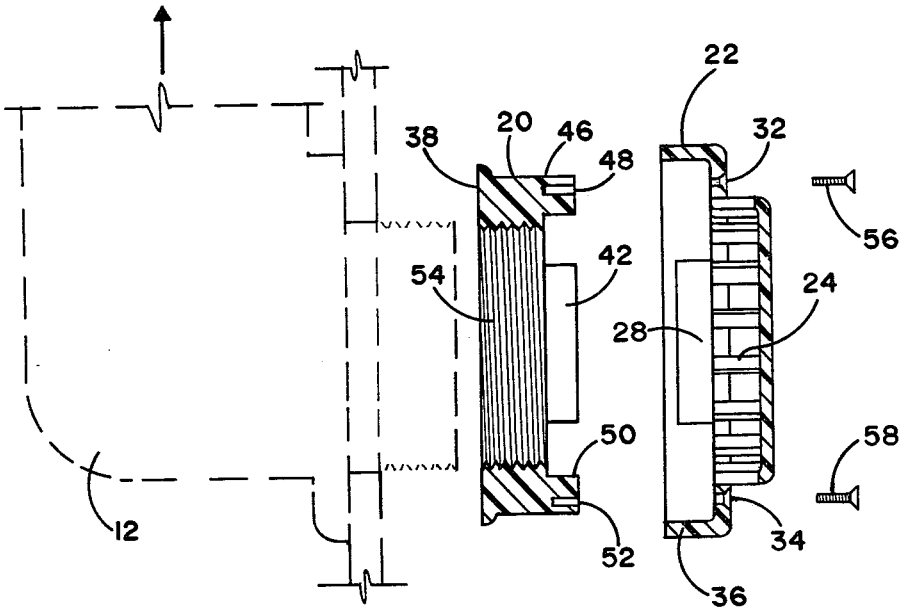
FIG. 5 is an exploded partially sectioned view of the principal components of the present invention.

The structure of the suction cover 22 may be best understood by concurrent reference to FIGS. 2, 3, and 5. As shown in those figures, suction cover 22 comprises a plurality of circularly arranged ribs 24 spaced apart to form a plurality of apertures 26 through which the water may flow. The rib structure of suction cover 22 is integral to an adjoining circular face plate 23 which may be ornamented with designs or the logo of the manufacturer or left plain. The rib structure is also integral to annular flange 25 which forms the top of a cylindrical wall structure 27 which circumscribes locking ring 20 and is spaced apart therefrom as shown best in FIG. 2. As seen in FIG. 3 there are a pair of screw holes 32 and 34 in the annular flange portion 25 of suction cover 22 which, as will be seen hereinafter more fully in conjunction with FIG. 5, provide means for placing a pair of securing screws through suction cover 22 and into aligned screw holes in locking ring 20. As seen in FIG. 3, suction cover 22 includes a pair of segments 28 and 30 which are integral to the interior surface of cylindrical wall 27 and which provide a keyed structure for guiding the mating of locking ring 20 and suction cover 22 during installation.

Locking ring 20 comprises a ring flange 38 and hexnut 40 as integral elements. A pair of aligning ridges 42 and 44 are adapted to lie adjacent segments 28 and 30 of suction cover 22 when the assembly is installed as shown in FIG. 2. As seen in FIG. 5, ridges 42 and 44 extend above the surface of hexnut 40. Also rising above the surface of hexnut 40 are a pair of screw posts 46 and 50 which have screw holes 48 and 52, respectively, to receive screws 56 and 58 shown in FIG. 5 for securing the suction cover 22 to the locking ring 20. Because the ridges 42 and 44 and posts 46 and 50 extend above the surface of hexnut 40, the suction cover 22 provides an additional path for water exiting through the assembly 10, namely, around the lip of cylindrical wall 27 and through the spacing between adjacent ridges and screw posts along the surface of hexnut 40. This secondary path for the exiting water provides an additional safety feature for the present invention. More specifically, the suction cover 22 of the present invention may be substantially smaller in size than the comparible element of the prior art assembly of FIG. 1 due to the unique configuration of the invention. It would therefore be possible for the user of a whirlpool bath in which the suction outlet assembly of the present invention is installed, to inadvertently block all of the apertures 26 of the suction cover 22 with a part of his body. However, because of the secondary path, a pressure differential will not create a sufficient suction effect to trap the user against the suction assembly.

It is to be noted that the locking ring 20 is secured to the threaded pipe 18 of elbow 12 by a compatible threaded interior annular surface 54 as shown best in FIG. 5.

It will now be seen that because of the unique construction of the present invention it is possible to secure the suction outlet assembly solely from the tub interior once the elbow 12 is positioned so that threaded pipe 16 extends through the orifice in tub wall 18. Furthermore, it will be understood that because elbow 12 is integral with flange 14 and threaded pipe 16, unlike the prior art assembly of FIG. 1, there is no need to rotate the elbow once it is positioned properly relative to tub wall 18. Accordingly, it is practical to insert threaded pipe 16 of elbow 12 through the tub wall from a considerable distance by first inserting an extended length of pipe into the pump end of elbow 12, and then manipulating the elbow to the appropriate position relative to the tub wall until the threaded pipe 16 is through the orifice. In this manner it is possible to completely eliminate any need for access to the immediate area outside tub wall 18 that is required in prior art suction outlet assemblies. Furthermore, it will be seen that because of the fixed relaionship between flange 14 and the remainder of elbow 12, the distance between the far end of elbow 12 and the exterior surface of the tub wall 18 is always fixed at a relatively minimal dimension as compared to the prior art. In a preferred embodiment of the present invention, the distance between the tub wall exterior surface and the farthest surface of elbow 12 is always about 2½ inches.

It will now be understood that what has been described herein is an improved suction outlet assembly primarily for use in whirlpool baths and the like. The assembly provides advantages relating to ease of installation, maintenance, and appearance in comparison to prior art whirlpool bath suction outlet assemblies. The invention is designed to extend through an aperture in the wall surface of a whirlpool bathtub to provide a passageway for exiting water that is sucked out by a recirculation pump located externally to the tub. The assembly of the invention comprises three principal components, namely, a novel elbow structure having an integral flange and threaded pipe, a locking ring and a suction cover. As a result of its unique but simple construction, the suction outlet assembly of the present invention is substantially easier to install because it does not require that the installer have complete access to the area along the exterior of the tub immediately adjacent the orifice through which the assembly is to be located. Furthermore, space requirements are reduced as compared to prior art assemblies because the distance between the tub surface and the point the assembly farthest from the exterior tub wall surface is always constant and minimum as compared to the prior art. Furthermore, because of its unique construction the present invention permits the use of a suction cover that is substantially smaller in cross section than prior art assemblies but that still preserves the multiple path safety feature that prevents inadvertent injury to a user whose body or portions thereof come in contact with the suction outlet assembly.

It will now be understood that various modifications may be made to the present invention as compared to the specific preferred embodiment described herein. By way of example, variations may be made to the geometry of the various components and to the manner in which they are physically interconnected without departing from the true spirit and scope of the invention which is to be limited only by the appended claims.

I claim:

1. A suction outlet assembly for use in whirlpool baths for providing a passageway for water pumped out of the bathtub through an orifice therein by a recirculation pump, the assembly comprising:

an elbow structure having an elbow pipe portion for directing said water to said pump after said water exits said bathtub, said elbow structure also having an integral flange for bearing against the exterior surface of said bathtub around said orifice, and an extended threaded portion for protruding through said orifice and into the interior of said bathtub, and means for securing said elbow structure relative to said bathtub, said means being threaded to engage said extended threaded portion of said elbow structure at the interior surface of said bathtub.

2. The assembly defined in claim 1 further comprising a suction cover having a plurality of separted passageways through which water in said bathtub can exit in response to said pump, and having means for engaging said securing means in fixed overlapping engagement therewith.

3. The assembly defined in claim 2 wherein said securing means and said suction cover also comprise relative keyed spacing elements to limit the relationship of said suction cover relative to said securing means and to provide additional passageways between said suction cover and said securing means for said exiting water.

4. The assembly defined in claim 2 wherein said securing means comprises a hexnut with an integral flange for bearing against said interior surface of said bathtub.

5. The assembly defined in claim 4 wherein said securing means further comprises at least one ridge extending from said hexnut in a direction opposite said flange for engaging said suction cover.

6. The assembly defined in claim 5 wherein said securing means further comprises at least one fastening post extending from said hexnut for receiving a fastening device, and wherein said suction cover is aligned with said post when said suction cover engages said securing means.

7. The assembly defined in claim 5 wherein said suction cover further comprises at least one keying segment for being aligned in close proximity with said ridge of said securing means for preventing relative motion therebetween when said suction cover engages said securing means.

8. The assembly defined in claim 4 wherein said securing means further comprises a pair of ridges extending from opposing hexogonical sides of said hexnut in a direction opposite said flange for engaging said suction cover and a pair of screw posts extending from opposing vertices of said hexnut in the same direction as said ridges, for receiving screws affixing said suction cover to said securing means.

* * * * *